US011417164B2

(12) United States Patent
Xu et al.

(10) Patent No.: US 11,417,164 B2
(45) Date of Patent: Aug. 16, 2022

(54) BUCKET AND VENDING MACHINE

(71) Applicant: Shandong New Beiyang Information Technology Co., Ltd., Shandong (CN)

(72) Inventors: Fengbo Xu, Shandong (CN); Kai Liu, Shandong (CN); Junchao Yuan, Shandong (CN); Qiangzi Cong, Shandong (CN); Jiansong Liu, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 198 days.

(21) Appl. No.: 16/957,050

(22) PCT Filed: Sep. 21, 2018

(86) PCT No.: PCT/CN2018/106969
§ 371 (c)(1),
(2) Date: Jun. 22, 2020

(87) PCT Pub. No.: WO2019/128334
PCT Pub. Date: Jul. 4, 2019

(65) Prior Publication Data

US 2020/0394866 A1 Dec. 17, 2020

(30) Foreign Application Priority Data

Dec. 29, 2017 (CN) ..... 201711471489.0

(51) Int. Cl.
*G07F 11/60* (2006.01)

(52) U.S. Cl.
CPC ..... *G07F 11/60* (2013.01)

(58) Field of Classification Search
CPC ..... B65G 59/00; G07F 11/60; G07F 11/58; G07F 11/00
USPC ..... 221/133, 123, 129, 124, 130
See application file for complete search history.

(56) References Cited

U.S. PATENT DOCUMENTS 4,762,250 A * 8/1988 Friberg ..... G07F 17/0078 221/133
6,682,289 B1 * 1/2004 Credle, Jr. ..... G07F 11/163 221/95
6,755,322 B1 * 6/2004 Herzog ..... G07F 11/58 221/133

(Continued)

FOREIGN PATENT DOCUMENTS

CN 103098103 A * 5/2013 ..... G07F 11/165
CN 103119633 A 5/2013

(Continued)

OTHER PUBLICATIONS

International Search Report dated Dec. 29, 2018, in the International Application No. PCT/CN2018/106969. 4 pages.

*Primary Examiner* — Rakesh Kumar
(74) *Attorney, Agent, or Firm* — Wilmer Cutler Pickering Hale and Dorr LLP

(57) ABSTRACT

A power assembly is configured to detachably mate with the power input member of a storage column of a vending machine, to supply power for the power input member. The driving assembly is connected to the power assembly and is configured to drive the power assembly to move reciprocatively in a width direction of the vending machine. Also disclosed is a vending machine.

16 Claims, 6 Drawing Sheets

(56) References Cited

U.S. PATENT DOCUMENTS

| | | | | |
|---|---|---|---|---|
| 6,808,082 | B2 * | 10/2004 | Ohkubo | G07F 11/58 221/133 |
| 2001/0048000 | A1 * | 12/2001 | Arai | G07F 11/62 221/133 |
| 2003/0075552 | A1 * | 4/2003 | Ohkubo | G07F 11/58 221/131 |
| 2003/0201275 | A1 * | 10/2003 | Tamura | G07F 11/1653 221/123 |
| 2004/0245280 | A1 | 12/2004 | Schramm et al. | |
| 2008/0290108 | A1 * | 11/2008 | Tsunoda | G07F 11/163 221/133 |
| 2011/0226795 | A1 * | 9/2011 | Sichich | G07F 11/165 221/133 |
| 2012/0118910 | A1 * | 5/2012 | Pinney | G07F 9/002 221/133 |

FOREIGN PATENT DOCUMENTS

| | | | | |
|---|---|---|---|---|
| CN | 106327679 | A | 1/2017 | |
| CN | 106327691 | A | 1/2017 | |
| CN | 207895565 | U | 9/2018 | |
| JP | 2006-318258 | A | 11/2006 | |
| WO | WO-2009138864 | A1 * | 11/2009 | G07F 11/165 |

* cited by examiner

BUCKET AND VENDING MACHINE

CROSS REFERENCE TO RELATED APPLICATIONS

This application is a national stage application of co-pending International Patent Application No. PCT/CN2018/106969 filed on Sep. 21, 2018, which claims the priority of Chinese Patent Application No. 201711471489.0, which was filed with the State Intellectual Property Office of the People's Republic of China on Dec. 29, 2017, the disclosures of both of which are incorporated herein by reference in their entireties.

TECHNICAL FIELD

The present disclosure relates to the field of vending machine, such as a bucket and a vending machine.

BACKGROUND

The Vending Machine (VEM) is a machine that can automatically deliver commodity according to the cash put in. The vending machine is an automated and common equipment not limited by time or place, and it can save manpower and facilitate transactions.

The vending machine in the related technology is subject to a low utilization ratio of internal space and a low commodity storage capacity.

SUMMARY

The present disclosure provides a bucket with the ability to improve the utilization ratio of the internal space of the vending machine, to improve the commodity storage capacity.

The present disclosure further provides a vending machine using above mentioned bucket, with the ability to improve the utilization ratio of the internal space of the vending machine, to improve the commodity storage capacity.

In an embodiment, the present disclosure provides a bucket for vending machine, including a bucket body having an inner cavity; a power assembly arranged in the inner cavity of the bucket body, and configured to detachably mate with the power input member of a storage column of the vending machine, to provide power to the power input member; a driving assembly connected with the power assembly and configured to drive the power assembly to move reciprocatively in a width direction of the vending machine.

In an embodiment, the present disclosure further provides a vending machine including a plurality of storage columns and any one of the above-mentioned buckets; the bucket body is configured to be opposite to any one of the plurality of storage columns; the driving assembly of the bucket is configured to drive the power assembly to move reciprocatively in a width direction of the vending machine, so that the power assembly detachably mates with the power input member of the storage column that the bucket body is opposite to, to provide power to the power input member for outputting the commodity.

In the figure: 100-bucket; 110-bucket body; 111-inner cavity; 1111-mounting space; 1112-commodity accommodating space; 120-power assembly; 121-first gear; 122-second gear; 123-third gear; 124-second motor; 1241-output shaft 125-mounting part; 1252-horizontal plate; 1254-vertical plate; 126-swing rod; 127-rotating shaft 128-connection part; 1281-clamping plate; 130-driving assembly; 132-first motor; 133-linear transmission assembly; 134-driving belt; 136-driving wheel; 138-driven wheel; 140-guiding assembly; 142-guiding post; 150-support frame; 152-partition plate; 154-protective plate; 200-vending machine; 210-storage column; 212-power input member; 214-moving part; 2142-driving belt; 2144-push plate; 220-storage cabinet; 222-cabinet body; 224-cabinet door; 2242-pickup port; 300-commodity.

DETAILED DESCRIPTION

The following detailed descriptions of embodiments of the present disclosure with reference to the drawings are not intended to limit the scope of the claimed disclosure, but merely represent some embodiments of the present disclosure.

In the description of the present disclosure, the terms indicating directions or position relationships are based on those on the drawings, and are used only for facilitating the description of the present disclosure and for simplifying description, not for indicating or implying that the target equipment or components must have a special direction and be structured and operated at the special direction, thereby they cannot be understood as the restrictions to the present disclosure. The vending machine includes a bucket and multiple storage columns. Each storage column is extended in the front-rear direction and is configured to store the commodities. The multiple storage columns are arranged in multiple rows and columns in the width direction and the height direction of the vending machine. Each storage column is configured with a moving part to deliver the commodity from the storage column. The bucket can move in the vending machine and can be butted with the preset storage columns, and it is configured to provide power to the moving parts inside the storage columns and receive the commodity falling from the storage columns. The bucket can carry the commodity to the pickup port of the vending machine for users to take them away.

Embodiment

Figure 1:
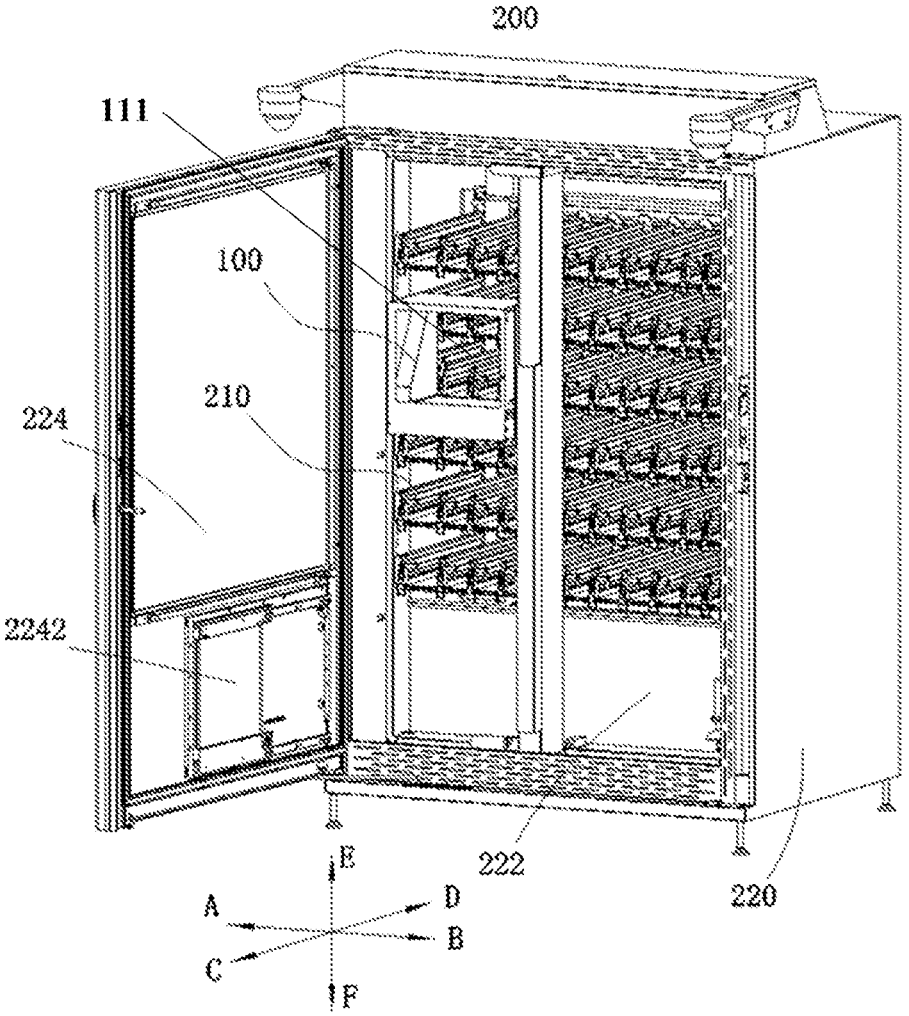
FIG. 1 is a structural view of a vending machine according to an embodiment of the present disclosure.
Figure 2:
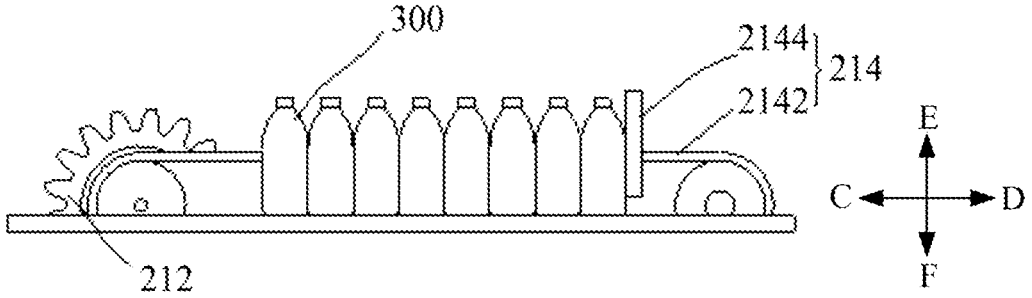
FIG. 2 is a structural view of a storage column of a vending machine according to an embodiment of the present disclosure.

Please refer to FIG. 1. FIG. 1 is an overall structural view of a vending machine 200 according to an embodiment of the present disclosure; FIG. 2 is a structural view of a storage column of the vending machine according to an embodiment of the present disclosure. As shown in FIG. 1 and FIG. 2, the embodiment provides a vending machine 200, including a storage cabinet 220, a bucket 100 and multiple storage columns 210 are arranged in the storage cabinet 220; a pickup port 2242 is arranged at the surface of the storage cabinet 220; the storage columns 210 are configured to accommodate commodity 300; the bucket 100 is configured to deliver the commodity 300 between the storage columns 210 and the pickup port 2242. In an embodiment, when the bucket 100 moves to an outlet of one of the multiple storage columns 210, the moving part 214 in the storage column 210 pushes the commodity 300 (such as beverage) out of the storage column 210 and sends the commodity to the bucket 100; the bucket 100 carries the commodity 300 to the pickup port 2242, so that the user can take away the commodity 300.

Please continue to refer to FIG. 1. The storage cabinet 220 is rectangular in shape, including a cabinet door 224 and a cabinet body 222. The cabinet door 224 is hinged to the cabinet body 222, and the above-mentioned pickup port 2242 is arranged at the lower part of the cabinet door 224. Multiple layers of shelf are arranged in the cabinet body 222 in the height direction of the vending machine; multiple storage columns 210 are arranged on each layer of shelf in the width direction of the vending machine; the storage columns 210 are extended from the rear to the front; the commodities 300 are placed in the storage columns 210. In an embodiment, the width direction of the vending machine is the AB direction in FIG. 1; the front-rear direction of the vending machine is the CD direction in FIG. 1, and the height direction of the vending machine is the EF direction in FIG. 1.

Please refer to FIG. 2 with reference to FIG. 1. The storage column 210 is configured with a power input member 212 and a moving part 214. The power input member 212 is arranged at the outlet of the storage column 210, and it is configured as being detachably connected with the power assembly 120 on the bucket 100. The power input member 212 is also in transmission connection with the moving part 214, so that the moving part 214 can drive the commodities 300 in the storage column 210 to move from rear to front, to make the commodity 300 finally fall into the bucket 100. Finally, the bucket 100 carries the commodity 300 to the pickup port 2242.

Please continue to refer to FIG. 2. In the embodiment, the power input member 212 is a gear arranged at the front end of the storage column 210. The moving part 214 includes a driving belt 2142 and a push plate 2144. The push plate 2144 is connected with the driving belt 2142. When the gear rotates, the rotating shaft drives the driving belt 2142 to move, and the driving belt 2142 drives the push plate 2144 to move forward. When the push plate 2144 moves from rear to front, it pushes the commodity 300 in the storage column 210 forward until the commodity is output to the bucket 100.

Please continue to refer to FIG. 1. The bucket 100 can move vertically and horizontally as driven by the driving mechanism, so that the bucket 100 is opposite to any one of the plurality of storage columns 210, so the commodity 300 in any storage column 210 can be taken out.

When the commodity 300 in the storage column 210 needs to be picked up, the power assembly 120 on the bucket 100 is to be connected with the power input member 212 on the storage column 210; generally, the bucket 100 is opposite to only one storage column 210; the bucket 100 is generally provided with large width and height to make the commodity 300 fall into the bucket 100. The above situation directly causes space waste of the cabinet 222, and the capacity of the cabinet 222 is relatively small. The bucket 100 in the embodiment is designed to improve the space utilization ratio and capacity of the cabinet 222.

Figure 3:
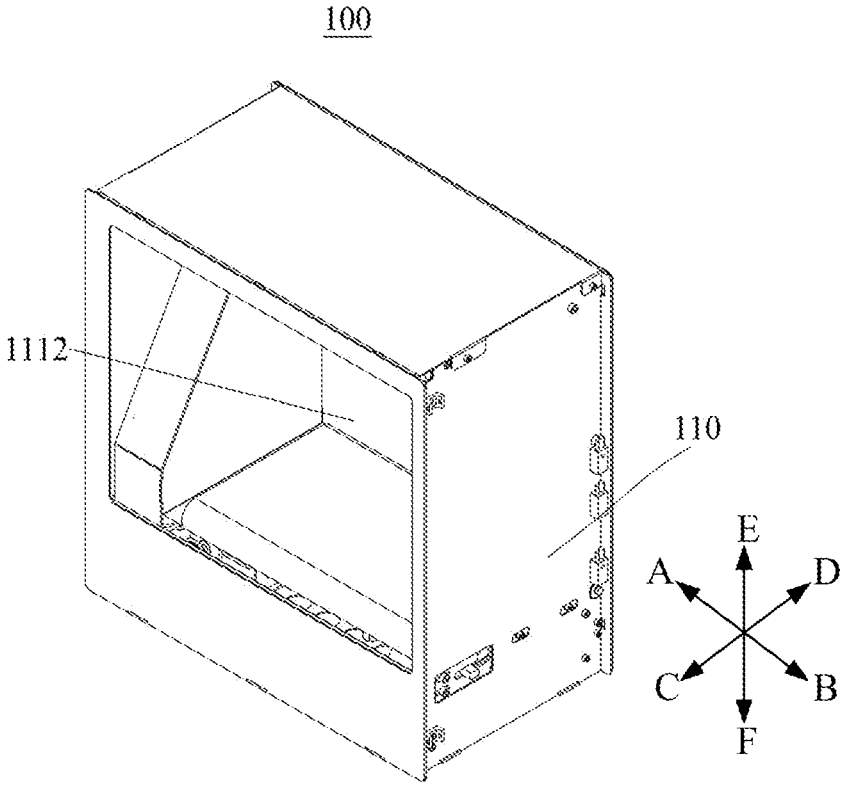
FIG. 3 is a structural view of a bucket from a first angle of view according to an embodiment of the present disclosure.
Figure 4:
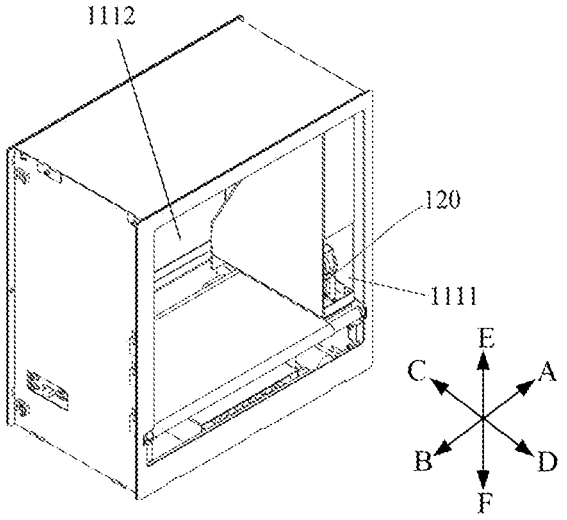
FIG. 4 is a structural view of a bucket from a second angle of view according to an embodiment of the present disclosure.
Figure 5:
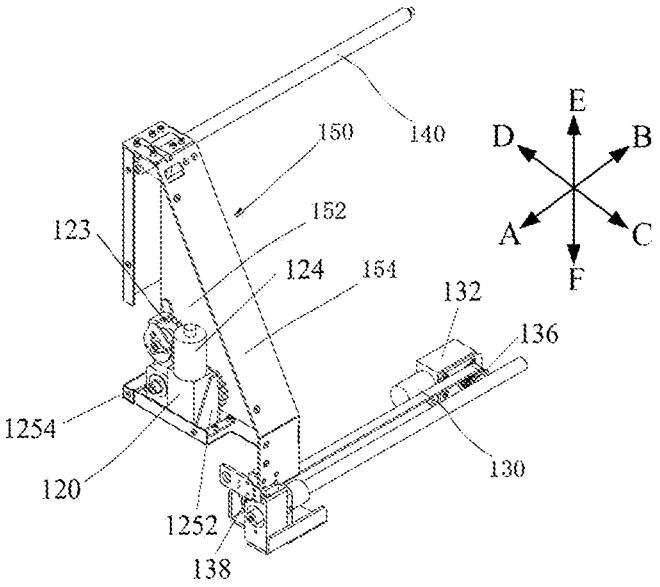
FIG. 5 is a structural view of a bucket from a third angle of view according to an embodiment of the present disclosure.

Please refer to FIG. 3 to FIG. 5. FIG. 3 and FIG. 4 are structural views of a bucket 100 from different angles, and FIG. 5 is a local structural view of the bucket according to an embodiment of the present disclosure from the third angle of view. The bucket 100 is rectangular in shape, including a bucket body 110 having an inner cavity 111, a power assembly 120 is configured to detachably mate with the power input member 212 of the storage column 210 and configured to supply power to the power input member 212, and a driving assembly 130 connected with the power assembly 120 and configured to drive the power assembly 120 to move reciprocatively in a the width direction of the vending machine. In an embodiment, the inner cavity 111 of the bucket body 110 is configured to accommodate the commodities 300 and the power assembly 120.

Since the driving assembly 130 can drive the power assembly 120 to move reciprocatively along the width direction of the vending machine, the bucket body 110 of the bucket 100 provided by the embodiment is configured to be opposite to the plurality of storage columns 210 simultaneously, the drive assembly 130 drives the power assembly 120 to move so that the power assembly 120 is detachably connected with the power input member 212 of any one of the plurality of storage columns 210, to provide power to the power input member 212 of the storage column 210 for outputting the commodity 300. Through the above design, the bucket 100 according to the embodiment can obtain the commodity 300 in any one of the plurality of storage columns 210. The use of the above-mentioned bucket 100 enables more storage columns 210 to be arranged in the vending machine, which improves the utilization ratio of the internal space of the vending machine and further increases the storage capacity of commodities 300 of the vending machine.

In an embodiment, the bucket 100 further includes a guiding assembly 140. The power assembly 120 is driven by the driving assembly 130 to move reciprocatively in the horizontal direction under the guidance of the guiding assembly 140. In this way, multiple storage columns 210 can be arranged in the rear of the bucket 100, and the power assembly 120 can move at the front end of any one of the plurality of storage columns 210, to provide power to the storage column. In other embodiments, the power assembly 120 is driven by the driving assembly 130 to move reciprocatively in the longitudinal direction under the guidance of the guiding assembly 140, and the "longitudinal direction" mentioned in the present disclosure is the height direction of the vending machine.

As shown in FIG. 3, the bucket body 110 is generally in the shape of a rectangular shell including a hollow inner cavity 111. The hollow inner cavity 111 is configured to accommodate the power assembly 120 and the commodities 300. The outer wall of the bucket body 110 is configured with an inlet and an outlet. When the bucket 100 moves to the front end of the preset storage column 210, the inlet can receive the commodity 300 falling from the storage column 210; when the bucket 100 moves to the pickup port 2242, the outlet can be used for the user to pick up the commodity.

Please refer to FIG. 5. The bucket body 110 is also configured with a support frame 150. The support frame 150 and the power assembly 120 can jointly move in the width direction of the bucket body 110. The support frame 150 includes a partition plate 152 and a protective plate 154. The protective plate 154 is connected with the partition plate 152 to form a cover structure. The partition plate 152 partitions the inner cavity 111 of the bucket body 110 into two relatively independent spaces, namely the mounting space 1111 and the commodity accommodating space 1112. The power assembly 120 is configured to be mounted in the mounting space 1111 and fixedly connected with the partition plate 152. The protective plate 154 is connected with the partition plate 152. The protective plate 154 and the partition plate 152 enclose the power assembly 120 in the mounting space 1111.

Since the support frame 150 is configured, it is possible to prevent the commodity 300 falling into the bucket body 110 from hitting the power assembly 120, which protects the power assembly 120; in addition, the support frame 150 can also prevent consumers from being hurt by the power assembly 120.

Figure 6:
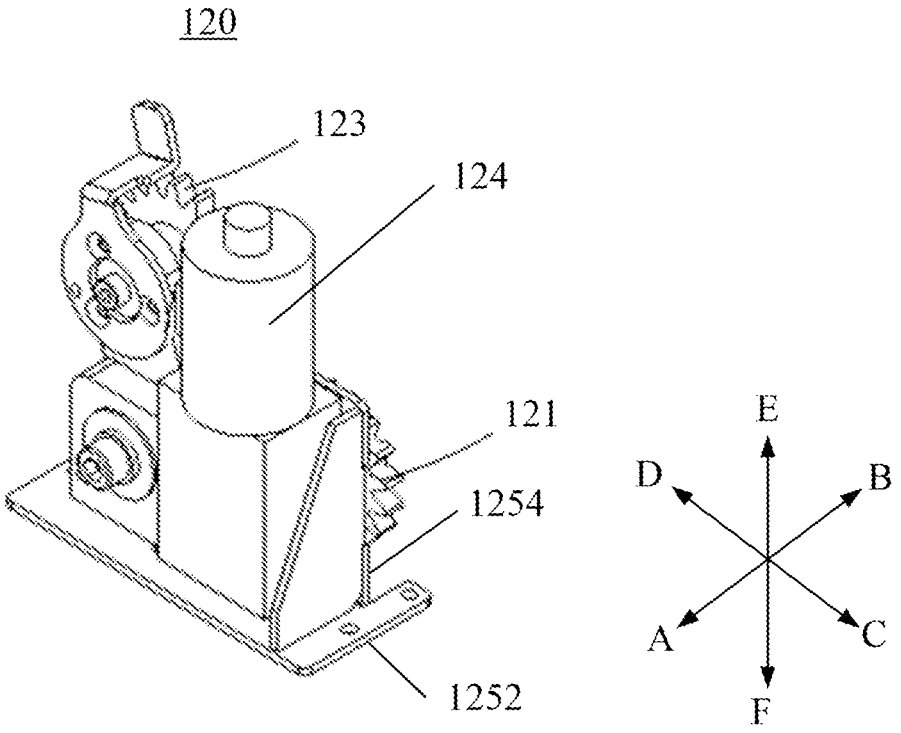
FIG. 6 is a structural view of a power assembly of a bucket from the third angle of view according to an embodiment of the present disclosure.
Figure 7:
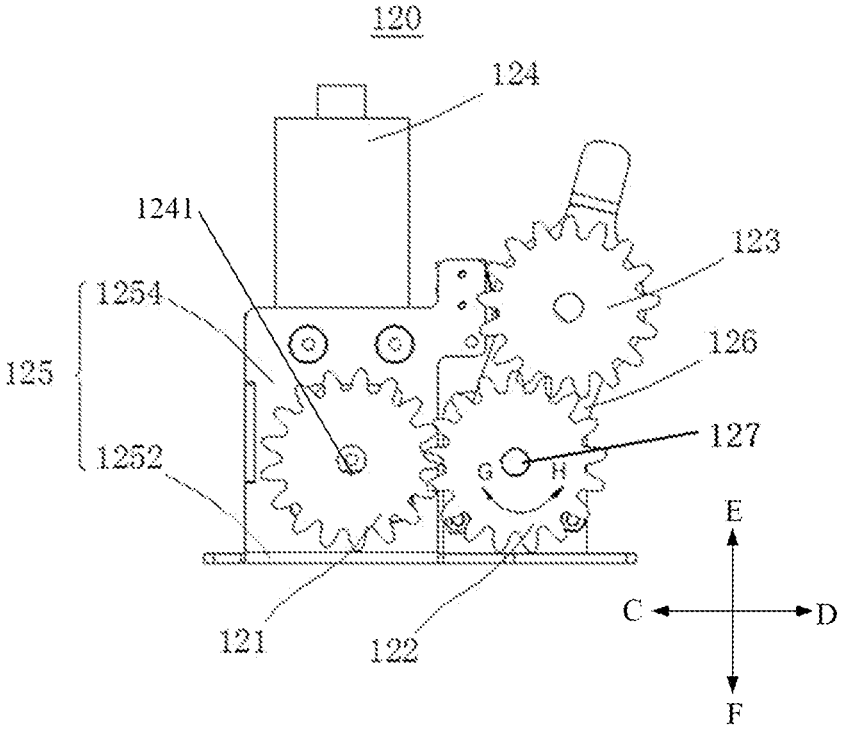
FIG. 7 is a structural front view of a power assembly of a bucket according to an embodiment of the present disclosure.

Please refer to FIG. 6 and FIG. 7 with reference to FIG. 5. FIG. 6 and FIG. 7 are structural views of the power assembly 120 from different angles. The power assembly 120 includes a mounting part 125, a second motor 124 arranged on the mounting part 125 and a transmission mechanism in transmission connection with the output shaft 1241 of the second motor 124; where the transmission mechanism is configured to move from a first position to a second position for transmission connection with the power input member 212 of the storage column 210 when the output shaft 1241 of the second motor 124 rotates in a first preset direction (such as the direction of Arrow G in FIG. 7); the transmission mechanism is also configured to move from the second position to the first position for detaching from the power input member 212 of the storage column 210 when the output shaft 1241 of the second motor 124 rotates in a second preset direction (such as the direction of Arrow H in FIG. 7).

In an embodiment, the power assembly 120 includes a second motor 124, a mounting part 125, a swing rod 126, a first gear 121, a second gear 122 and a third gear 123.

The mounting part 125 includes a horizontal plate 1252 and a vertical plate 1254. The horizontal plate 1252 is fixedly connected with the partition plate 152 of the support frame 150 and is configured to support other components of the entire power assembly 120; the vertical plate 1254 is vertically connected with the upper surface of the horizontal plate 1252 and is arranged in parallel with the partition plate 152 at an interval.

The second motor 124 is fixedly connected to the mounting part 125 and is in transmission connection with the first gear 121. The first gear 121, the second gear 122 and the third gear 123 are located between the vertical plate 1254 and the partition plate 152. The first gear 121 is rotationally connected with the vertical plate 1254; the second gear 122 is rotationally connected with the swing rod 126 through a rotating shaft 127 in one direction; the rotating shaft 127 is also rotationally connected to the vertical plate 1254, and the third gear 123 is rotationally connected with the free end of the swing rod 126; the second gear 122 is engaged with the first gear 121 and the third gear 123 at the same time.

The free end of the swing rod 126 is connected with the mounting part 125 through an elastic member. The free end of the swing rod 126 is always subject a tendency to rotate towards the direction close to the storage columns 210 due to the elastic force of the elastic member, so that the swing rod 126 can drive the power input member 212 of the third gear 123 close to the storage columns 210 and can be connected with the power input member 212 without additional external force.

In the embodiment, the rotating shaft 127 is fixedly connected with the second gear 122 and connected to the swing rod 126 through a one-way bearing; the elastic member is a tension spring; the first end of the tension spring is connected with the free end of the swing rod 126, and the second end of the tension spring is connected with the mounting part 125. In an embodiment, the elastic member may also be a torsion spring.

When the second gear 122 rotates in the first preset direction, the rotating shaft 127 rotates relative to the swing rod 126 through the one-way bearing; the one-way bearing slips relative to the swing rod 126, and the swing rod 126 is not subject to the torque from the rotating shaft 127. At this time, the elastic member pulls the swing rod 126 to swing, so that the swing rod 126 drives the third gear 123 to move to the second position where the third gear 123 can just be connected with the power input member 212 (such as gear or spline) of the storage column 210.

When the second gear 122 rotates in a second preset direction opposite to the first preset direction, since the rotating shaft 127 is connected with the swing rod 126 through the one-way bearing, at this time, the one-way bearing is tightly clamping, and the rotating shaft 127 drives the swing rod 126 to rotate synchronously; the third gear 123 moves to the first position with the swing rod 126; at the first position, the third gear 123 is detached from the power input member 212 of the storage column 210. In an embodiment, the third gear 123 is retracted into the bucket body.

Figure 8:
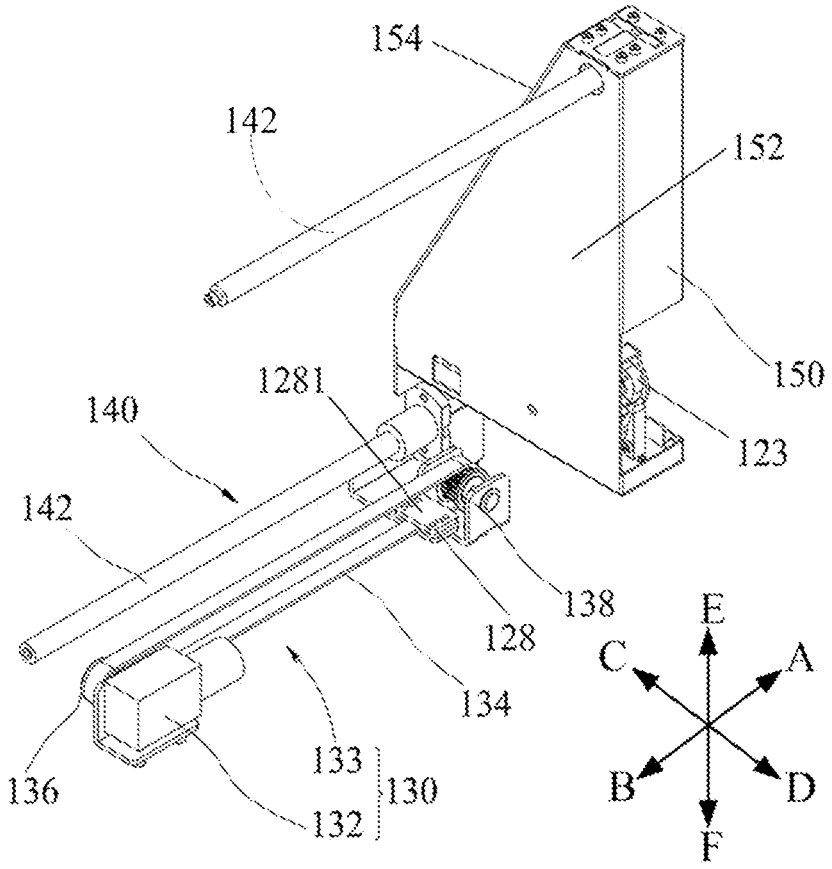
FIG. 8 is a local structural view of a bucket from the second angle of view according to an embodiment of the present disclosure.

Please refer to FIG. 8 with reference to FIG. 5 and FIG. 7. FIG. 8 illustrates the structure of the driving assembly 130. The driving assembly 130 includes a first motor 132 and a linear transmission assembly 133. The first motor 132 is in transmission connection with the linear transmission assembly 133, and the linear transmission assembly 133 is connected with the power assembly 120. The linear transmission assembly 133 includes a driving belt 134, a driving wheel 136 and a driven wheel 138 arranged at an interval in the horizontal direction. The first motor 132 is fixedly connected to the bucket body 110 through the mounting part 125; the driving wheel 136 is connected with the output shaft of the first motor 132; the shaft of the driven wheel 138 is connected with the bucket body 110; the driving belt 134 is socketed on the driving wheel 136 and the driven wheel 138; the driving wheel 136 can drive the driven wheel 138 to rotate through the driving belt 134. The power assembly 120 is connected with the driving belt 134. When the driving belt 134 moves, the power assembly 120 is driven to move synchronously.

In the embodiment, the driving belt 134 is a synchronous belt, and the driving wheel 136 and the driven wheel 138 are synchronous belt wheels. To facilitate the connection between the power assembly 120 and the driving belt 134, an additional connection part 128 is arranged on the power assembly 120. The connection part 128 includes two interconnected clamping plates 1281 that clamp the driving belt 134. In an embodiment, the two clamping plates 1281 are connected by bolts to facilitate assembling and adjust the clamping force.

As shown in FIG. 5 and FIG. 8, in the embodiment, the guiding assembly 140 is connected with the bucket body 110 to guide the power assembly 120 to move, and the power assembly 120 is slidably connected with guiding assembly 140. In an embodiment, the guiding assembly 140 includes two guiding posts 142, which extend horizontally and are installed on the upper and lower parts of the power assembly 120 respectively. The power assembly 120 is supported by two guiding posts 142 to make power assembly 120 suspend relative to the inner wall of the bucket body 110. In an embodiment, two guiding posts 142 of the guiding assembly 140 extend longitudinally; in the horizontal direction, two guiding posts 142 are installed on both ends of the power assembly 120 respectively.

The above design enables the guiding post 142 not only provide guidance, but also support the power assembly 120, so that there is a certain clearance between the power assembly 120 and the inner wall of the bucket body 110 to make the movement of the power assembly 120 more smooth. In addition, the position of the guiding post 142 not only avoids the interference between the guiding post 142 and the commodity 300, but also makes the whole structure of the bucket 100 more stable.

The operating principles of the bucket 100 and the vending machine 200 according to the embodiment are as follows:

As shown in FIG. 1, when customer wants to obtain the commodity 300 in the preset storage column 210, the driving mechanism drives the bucket 100 to the position opposite to the preset storage column 210, the drive assembly 130 drives the power assembly 120 to move, and the power assembly 120 connects with the power input member 212 of the preset storage column 210, and the moving part 214 in the preset storage column 210 pushes the commodity 300 into the bucket 100. The power assembly 120 can reciprocating motion horizontally and the bucket can move horizontal and longitudinal under the driver of the driving mechanism, therefore, when customer requires, the bucket 100 can take out the commodity 300 in the storage columns at any position through the horizontal motion of the power assembly 120 and up, down, left and right motions of the bucket 100. Therefore, the bucket 100 and the vending machine 200 according to the embodiment make full use of the internal space of the vending machine and increase the capacity.

The embodiment is only one of the embodiments of the present disclosure. In other embodiments, the guiding assembly 140 may not be provided, for example, the power assembly 120 is slidably connected with the inner wall of the bucket body 110.

In an embodiment, the linear transmission assembly 133 may also be provided with other structural types, for example, a gear-and- storage column structure may be used: the gear is installed on the power assembly 120, and the storage column extends horizontally; the gear is engaged with the storage column, and the first motor 132 drives the gear to rotate; in other embodiments, a screw-nut structure may be used: the nut is installed on the power assembly 120, the screw rod extends horizontally, the first motor drives the screw rod to rotate, the rotation of the nut around the screw rod is limited to make the nut motion axially along the screw rod, and the power assembly also move along the screw rod; in other embodiments, a cylinder structure may be used: the free end of the piston rod of the air cylinder is connected with the power assembly 120 and the air cylinder body is connected with the bucket body 110.

In an embodiment, the guiding assembly 140 may be a storage column, and the power assembly 120 is provided with a gear coupled with the storage column. When the gear rotates, the power assembly 120 moves along the storage column.

What is claimed is:

1. A bucket for vending machine, comprising:

a bucket body having an inner cavity;

a power assembly, is arranged in the inner cavity of the bucket body, and configured to detachably mate with a power input member of a storage column of the vending machine, to supply power to the power input member; and a driving assembly, connected to the power assembly and is configured to drive the power assembly to move reciprocatively in a width direction of a vending machine;

wherein the driving assembly comprises a first motor and a linear transmission assembly;

the first motor is connected with the bucket body; the first motor is in transmission connection with the linear driving assembly; the linear driving assembly is connected with the power assembly;

wherein the linear driving assembly comprises a driving belt, a driving wheel and a driven wheel arranged at an interval in the width direction of the vending machine;

the driving wheel is in transmission connection with the first motor; the driving wheel and the driven wheel are rotationally connected with the bucket body;

the driving belt is socketed on the driving wheel and the driven wheel; the power assembly is connected with the driving belt when the driving belt moves, the driving belt is configured to drive the power assembly to move synchronously;

wherein a connection part is arranged on the power assembly and fixedly connected to a mounting part of the power assembly, the connection part includes two interconnected clamping plates that clamp the driving belt.

2. The bucket according to claim 1, wherein the power assembly comprises a second motor and a transmission mechanism in transmission connection with the output shaft of the second motor arranged on the mounting part, wherein the transmission mechanism is configured to move from a first position to a second position for transmission connection with the power input member of the storage column when the output shaft of the second motor rotates in a first preset direction, wherein the transmission mechanism is further configured to move from the second position to the first position for detaching from the power input member of the storage column when the output shaft of the second motor rotates in a second preset direction, and wherein the first preset direction is opposite to the second preset direction.

3. The bucket according to claim 1, wherein the power assembly comprises a mounting part, a second motor, and a transmission mechanism in transmission connection with the output shaft of the second motor arranged on the mounting part, wherein the transmission mechanism is configured to move from a first position to a second position for transmission connection with the power input member of the storage column when the output shaft of the second motor rotates in a first preset direction, wherein the transmission mechanism is further configured to move from the second position to the first position for detaching from the power input member of the storage column when the output shaft of the second motor rotates in a second preset direction, and wherein the first preset direction is opposite to the second preset direction.

4. The bucket according to claim 1, wherein the bucket further comprises a guiding assembly, wherein the guiding assembly is connected with the bucket; the power assembly is slidably connected with the guiding assembly, and wherein the power assembly is configured to be guided to move in the width direction of the vending machine.

5. The bucket according to claim 4, wherein the guiding assembly comprises two guiding posts, wherein the two guiding posts are extended in the width direction of the vending machine, and wherein the two guiding posts are respectively arranged at the upper part and the lower part of the bucket.

6. The bucket according to claim 5, wherein:

the bucket body is provided with a support frame connected to the mounting part of the power assembly, the two guiding posts are respectively fixed to the upper part and the lower part of the bucket body, each of the two guiding posts penetrates through the support frame, and the two guiding posts are configured to support the power assembly by supporting the support frame so as to enable the power assembly to suspend relative to the inner wall of the bucket body.

7. The bucket according to claim 1, wherein the bucket body is provided with a support frame, wherein the support frame comprises a partition plate, wherein the partition plate is connected with the power assembly, and is configured to move, along the width direction of the vending machine, with the power assembly, wherein the partition plate is configured to divide the inner cavity of the bucket body into a mounting space and a commodity accommodating space, wherein the mounting space and the commodity accommodating space are arranged in the width direction of the vending machine, and wherein the power assembly is arranged in the mounting space.

8. The bucket according to claim 7, wherein the support frame further comprises a protective plate, wherein the protective plate is connected with the partition plate, and wherein the protective plate and the partition plate are arranged to enclose the power assembly in the mounting space.

9. The bucket according to claim 1, wherein the power assembly comprises a a second motor and a transmission mechanism in transmission connection with the output shaft of the second motor arranged on the mounting part, wherein the transmission mechanism is configured to move from a first position to a second position for transmission connection with the power input member of the storage column when the output shaft of the second motor rotates in a first preset direction, wherein the transmission mechanism is further configured to move from the second position to the first position for detaching from the power input member of the storage column when the output shaft of the second motor rotates in a second preset direction, and wherein the first preset direction is opposite to the second preset direction.

10. The bucket according to claim 1, wherein the bucket further comprises a guiding assembly, wherein the guiding assembly is connected with the bucket, wherein the power assembly is slidably connected with the guiding assembly, and wherein the power assembly is configured to be guided to move in the set direction width direction of the vending machine.

11. The bucket according to claim 1, wherein the bucket further comprises a guiding assembly, wherein the guiding assembly is connected with the bucket, wherein the power assembly is slidably connected with the guiding assembly, and wherein, the power assembly is configured to be guided to move in the width direction of the vending machine.

12. A vending machine, comprising a plurality of storage columns and a bucket, wherein the bucket for the vending machine comprises:

a bucket body having an inner cavity;

a power assembly, is arranged in the inner cavity of the bucket body, and configured to detachably mate with a power input member of a storage column of the vending machine, to supply power to the power input member; and a driving assembly, connected to the power assembly and configured to drive the power assembly to move reciprocatively in a set direction width direction of the vending machine;

wherein the bucket body of the bucket is configured to be opposite to one of the plurality of storage columns, wherein the driving assembly of the bucket is configured to drive the power assembly of the bucket to move reciprocatively in the width direction of the vending machine, so that the power assembly detachably mates with the power input member of the one of the plurality of storage columns that the bucket body is opposite to, to provide power to the power input member for outputting commodities;

wherein the driving assembly comprises a first motor and a linear transmission assembly;

wherein the first motor is connected with the bucket body; the first motor is in transmission connection with the linear driving assembly; the linear driving assembly is connected with the power assembly;

wherein the linear driving assembly comprises a driving belt, a driving wheel and a driven wheel arranged at an interval in the width direction of the vending mechanism;

wherein the driving wheel is in transmission connection with the first motor; the driving wheel and the driven wheel are rotationally connected with the bucket body;

wherein the driving belt is socketed on the driving wheel and the driven wheel; the power assembly is connected with the driving belt when the driving belt moves, the driving belt is configured to drive the power assembly to move synchronously;

wherein a connection part is arranged on the power assembly and fixedly connected to a mounting part of the power assembly, the connection part includes two interconnected clamping plates that clamp the driving belt.

13. The vending machine according to claim 12, wherein the bucket further comprises a guiding assembly, wherein the guiding assembly is connected with the bucket, wherein the power assembly is slidably connected with the guiding assembly, and wherein the power assembly is configured to be guided to move in the width direction of the vending machine.

14. The vending machine according to claim 13, wherein the guiding assembly comprises two guiding posts, wherein the two guiding posts are extended in the width direction of the vending machine, and wherein the two guiding posts are respectively arranged at the upper part and the lower part of the bucket.

15. The vending machine according to claim 14, wherein:

the bucket body is provided with a support frame connected to the mounting part of the power assembly, the two guiding posts are respectively fixed to the upper part and the lower part of the bucket body, each of the two guiding posts penetrates through the support frame, and the two guiding posts are configured to support the power assembly by supporting the support frame so as to enable the power assembly to suspend relative to the inner wall of the bucket body.

16. The vending machine according to claim 12, wherein the bucket body is provided with a support frame, wherein the support frame comprises a partition plate, wherein the partition plate is connected with the power assembly, and is configured to move along the width direction of the vending machine with the power assembly, wherein the partition plate is configured to divide the inner cavity of the bucket body into a mounting space and a commodity accommodating space, wherein the mounting space and the commodity accommodating space are arranged in the width direction of the vending machine, and wherein the power assembly is arranged in the mounting space.

* * * * *